United States Patent [19]

Tucker

[11] Patent Number: 4,534,079

[45] Date of Patent: Aug. 13, 1985

[54] TRANSPORTABLE FOLDING BRIDGE

[75] Inventor: Maurice K. Tucker, Bournemouth, England

[73] Assignee: The Secretary of State for Defence in Her Britannic Majesty's Government of the United Kingdom of Great Britain and Northern Ireland, London, England

[21] Appl. No.: 503,254

[22] Filed: Jun. 10, 1983

[30] Foreign Application Priority Data

Jun. 17, 1982 [GB] United Kingdom ..... 8217584

[51] Int. Cl.[3] ..... E05D 7/04

[52] U.S. Cl. ..... 14/14; 14/2.4; 16/223; 16/242; 16/348; 16/366; 16/371

[58] Field of Search ..... 16/297, 302, 307, 308, 16/335, 348, 361, 366, 371, 374, 388; 76/223, 242, 370; 14/2.4, 2.6, 14, 36, 37

[56] References Cited

U.S. PATENT DOCUMENTS

| | | | |
|---|---|---|---|
| 534,704 | 2/1895 | Worden | 14/37 |
| 1,310,203 | 7/1917 | Meyrowitz | 16/307 X |
| 1,771,008 | 7/1930 | Reinhardt | 16/366 X |
| 2,182,704 | 12/1939 | Rea | 16/371 X |
| 2,332,404 | 10/1943 | Smith | 16/371 X |
| 4,131,378 | 12/1978 | Daws | 16/388 X |
| 4,400,994 | 12/1981 | Skjaeveland | 16/242 X |

FOREIGN PATENT DOCUMENTS

| | | |
|---|---|---|
| 0017226 | 4/1980 | United Kingdom . |
| 1588570 | 4/1981 | United Kingdom . |
| 0027481 | 4/1981 | United Kingdom . |

*Primary Examiner*—Fred Silverberg

*Attorney, Agent, or Firm*—Cushman, Darby & Cushman

[57] ABSTRACT

A folding bridge is provided with flush top and bottom chords when opened through 180° by a hinge comprising two hinge blocks pivotally interconnected by a swinging link, the rotation of each block relative to the link being limited to 90° by a stop mechanism and being sequenced by a restraining mechanism. In specific application to a bridge, the restraining mechanism is gravity urged.

7 Claims, 6 Drawing Figures

TRANSPORTABLE FOLDING BRIDGE

FIELD OF THE INVENTION

This invention relates to a hinge having two flush surfaces when opened through 180° of rotation. In particular, but not exclusively, it is applicable to large structural units such as those of a folding bridge and is adaptable to an unfolding or substantially scissoring method of operation, i.e. a known method of folding and unfolding two structures interconnected by a hinge, by rotation of one of the structures about an axis remote from the hinge.

BACKGROUND OF THE INVENTION

It is desirable that a transportable folding bridge should have in its unfolded state, both a flush bottom face to permit passage of the bridge across rollers during launching and a flush top face for ease of traffic flow across the bridge.

Simple hinges, commonly applied to existing bridges and many other folding structures have a single hinge pin and bush which are necessarily axially located in the plane of one of the faces in order to provide a full 180° rotation, and consequently the pin and bush must partially protrude from that face when the hinge is opened.

A more complicated type of hinge providing a flush surface at both faces when opened through 180° is known for use with lightweight folding structures, e.g. table leaves or countertop flaps, in which the two adjoining portions of the structure are separately pinned to an intermediate swinging link in a plane lying between the two faces. This type of hinge opens erratically, rotation occurring indiscriminately at either one of the two hinge pins at any moment, and when a pair of the hinges are used in line, relative twisting of the two attached portions occurs. Consequently the hinge is only suitable for use with fairly lightweight structures that can be manually controlled during opening and closing.

SUMMARY OF THE INVENTION

The present invention seeks to provide a flush hinge of the swinging link type from which indiscriminate hinge pin rotation is eliminated.

In accordance with the present invention a flush hinge including a first and a second hinge block each having an end face with opposed first and second edges, which end faces and edges are mutually confrontable when the hinge is opened, and a swinging link rotatably attached at each of its ends to a respective one of the hinge blocks so as to be rotatable about an axis adjacent and parallel with the first edge of the respective end face, is further provided with a stop mechanism engageable between the link and each hinge block for limiting the angle of rotation between the link and the hinge block to substantially one half of the total angle of rotation between the two hinge blocks, and a restraining means operative between the link and the first hinge block so as to resist rotation therebetween so long as rotation of the second hinge block relative to the link is possible.

The link may be conveniently attached to the hinge blocks by a first and a second hinge pin respectively and the restraining means may comprise a pre-loaded torsion spring located at the first hinge pin. The strength of this spring need be sufficient only to overcome any differential hinge pin friction that exists and any moment that may be imparted by adverse hinge pin reactions arising in specific applications.

Preferably the end face of each hinge block is further provided with engagement means adjacent the second edge, which means may conveniently comprise cooperative male and female shear lugs, if the opened hinge is likely to be subjected to shear loads only. Alternatively, if the open hinge is also required to resist tensile loads the engagement means preferably comprises mutually alignable holes in each hinge block through which a pin can be inserted.

The hinge may be adapted for scissoring by means of a conventional scissoring attachment comprising a deflectable scissoring lever and a fixed fulcrum arm cooperative with the lever. The attachment is fastened to the second hinge block adjacent the second edge so as to project outwardly from the end face. When a pair of structures to which the hinge is applied is to be unfolded by the scissoring method the structure to which the first hinge block is attached is itself deflectably supported upon a support member at a pivot point remote from the hinge and the scissoring lever is also linked to the support member. If the hinge is scissored open by rotating the first hinge member downwardly through a substantially vertical quadrant above the horizontal plane of the supporting pivot point, the torsion spring at the first hinge pin can be omitted as the necessary restraining means is provided by the action of the dead weight of the second hinge member and its attached structure upon the link.

BRIEF DESCRIPTION OF THE DRAWINGS

An embodiment of the invention will now be described by way of example only, with reference to the accompanying drawings of which

DETAILED DESCRIPTION OF THE INVENTION

Figure 1:
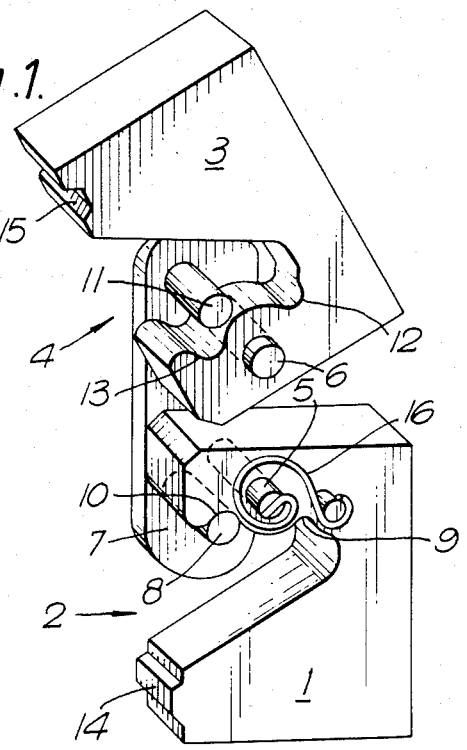
FIG. 1 is a perspective view of a rotation controlled, swinging link hinge.

The hinge illustrated in FIG. 1 comprises a first hinge block 1 having a recessed end face 2 and a second hinge block 3 having a recessed end face 4, each respectively pivoted by hinge pins 5 and 6 to a swinging link 7.

The available rotation of the link 7 with respect to the block 1 is limited to 90° by means of a stop pin 8 attached to the link 7 which pin is engageable with two limit notches 9 and 10 appropriately located in the recessed end face 2 of the block 1. Rotation of the link 7 with respect to the block 3 is similarly limited to 90° by an identical arrangement of a stop pin 11 at the other end of the link 7 and limit notches 12 and 13 in the recessed end face 4 of the block 3.

The end faces 2 and 4 are also provided with mating male and female shear lugs 14 and 15 respectively, which engage when the hinge is fully open, i.e. when the end faces 2 and 4 confront.

A preloaded torsion spring 16 comprising the restraining means, is connected between the block 1 and the hinge pin 5 so as to resist counterclockwise (as drawn) rotation of the link 7 relative to the block 1.

Figure 2:
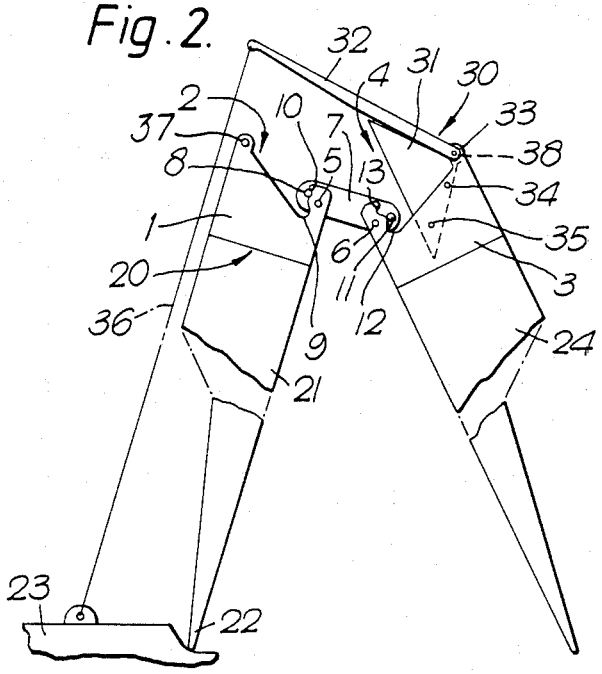
FIG. 2 is a side view of a similar hinge attached to a pair of bridge girders and adapted for scissoring operation.
Figure 3:
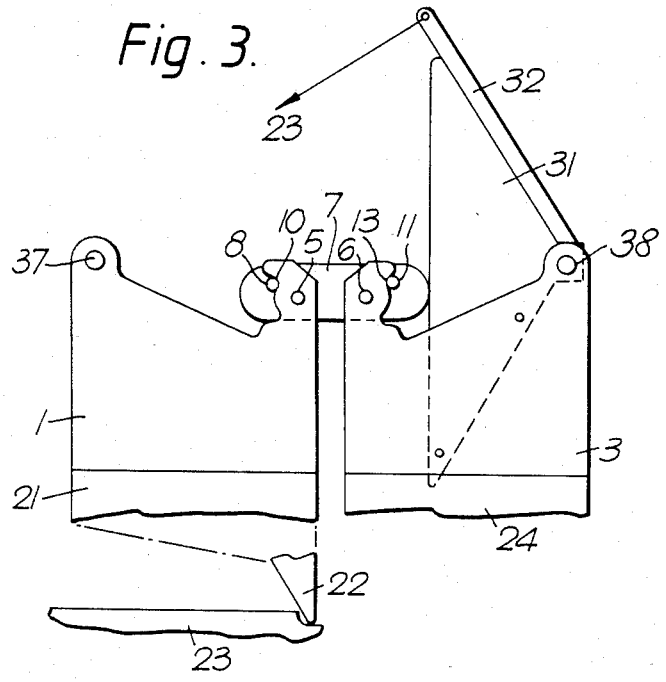
FIGS. 3 to 6 are diagrammatic representations of the hinge of FIG. 2, respectively depicted in the fully folded position, during the first 90° of opening, during the second 90° of opening, and in the fully opened position.
Figure 4:
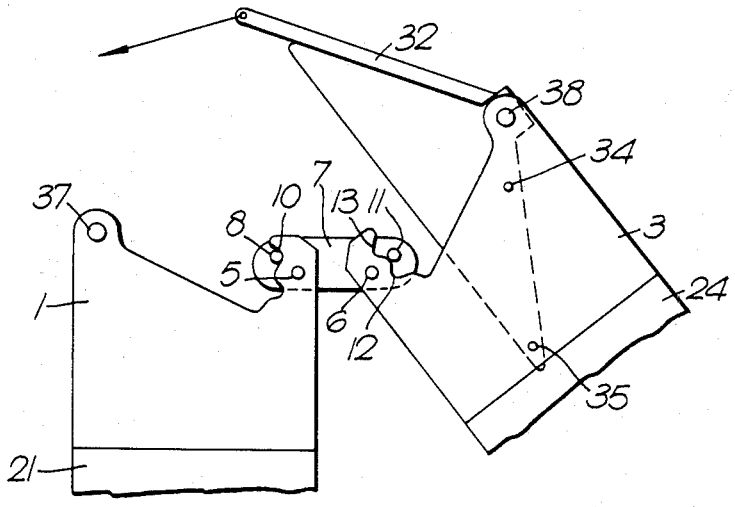

A similar hinge is depicted in FIG. 2 applied to a pair of bridge girders. In this arrangement the hinge block 1 is attached to one end 20 of a near bridge girder 21, which girder is pivotally supported at its other end 22 upon a support member 23. The other hinge block 3 supports a far bridge girder 24.

This arrangement is adapted for scissoring operation or scissors launch by a scissoring attachment 30 comprising a fulcrum arm 31 to which one end of a scissoring lever 32 is rotatably attached at a scissoring pivot 33, the fulcrum arm 31 being fixed to the hinge block 3 by pins 34 and 35. The other end of the lever 32 is tied by a linkage 36 to the support member 23. In this particular arrangement the torsion spring 16 of FIG. 1 is no longer necessary, as its function as a restraining means is performed by the pendent girder 24. Also, so that the fully opened girders will be resistive to tensile loads as well as shear loads, the male and female shear lugs 14 and 15 of FIG. 1 are replaced by alignable eyes 37 and 38 respectively which may be interconnected by a locking pin 39 (see FIG. 6).

Unfolding of the girders will now be described with reference to the FIGS. 2 to 6. When the folded bridge girders 21 and 24 are to be deployed they are first raised to the position shown in FIG. 2 by a first hydraulic ram (not shown) provided on the support member 23. In this position the stop pins 8 and 11 are engaged with the notches 10 and 13 respectively. As clockwise rotation of the near girder 21 continues the linkage 36 tightens causing the scissoring lever 32 to bear upon the fulcrum arm 31 to rotate the far girder 24 counterclockwise about its hinge pin 6 (FIGS. 2 and 4) until the stop pin 11 engages with the notch 12, by which time the girders have unfolded by 90°.

Figure 5:
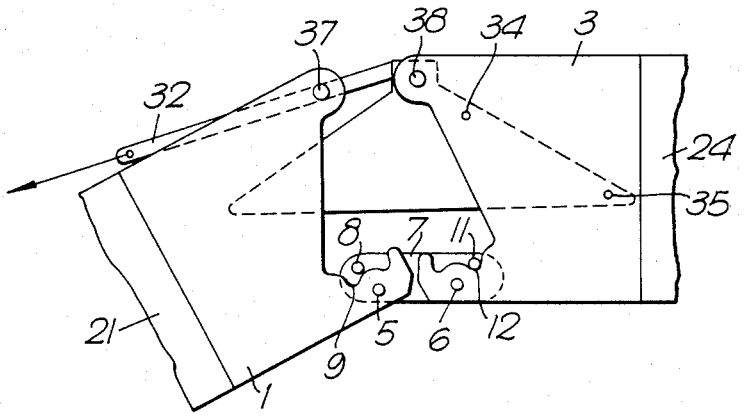
Figure 6:
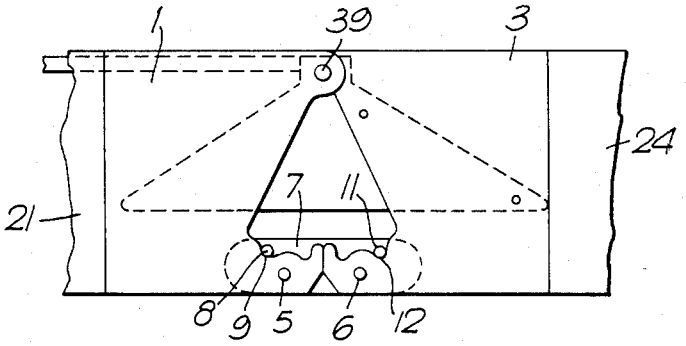

No rotation can occur at the hinge pin 5 during this first 90° of unfolding because the clockwise turning moment imparted to the link 7 by the deadweight of the girder 24 acts to lock the stop pin 8 into engagement with the notch 10. However, once the stop pin 11 engages with the notch 12 the counterclockwise turning moment imparted to the girder 24 by the scissoring lever 32 is transmitted to the link 7 via the pin 11 thus disengageing the stop pin 8 from the notch 10 and transferring all further rotation to the hinge pin 5 (FIG. 5). This transferred rotation then continues throughout the second 90° of unfolding (FIG. 5) until the stop pin 8 engages the notch 9, whereupon the girders are fully unfolded (FIG. 6). The locking pin 39 can then be inserted in the aligned eyes 37 and 38 and the scissoring attachment 30 may also be removed if desired.

During the second 90° of unfolding (FIG. 5), the scissoring lever 32 ceases to bear upon the fulcrum arm 31 and pulls directly on the scissoring pivot 33 to draw the far girder 24 and the link 7 into alignment with the near girder 21.

Refolding of the bridge is accomplished by reversing the whole process. Because the arrangement is totally symmetrical, including the scissoring attachment, the refolding may be done from either end of the bridge.

I claim:

1. A folding bridge adapted for unfolding in a substantially vertical plane from a support member, including a first and a second bridge girder co-engaged in end-to-end configuration by a hinge and disposed on the prior to unfolding, the hinge including:

a first and a second hinge block attached to said first and second bridge girders respectively, each having an end face with parallel first and second edges, the two end faces being mutually confrontable when the hinge is fully opened, the first and second edges thereupon being disposed as lower and upper edges respectively;

an attachment comprising a lever having two ends, one being pivotally attachable to the second hinge block adjacent the second edge so as to be rotatable about a pivot axis parallel with the second edge, the other being tied to the support member via a linkage, and a fulcrum arm rigidly attachable to the second hinge block having a bearing surface extending radially outwards from the pivot axis so as to be engagable with the lever;

a swinging link having a first and a second end respectively pivotally attached to the first and second hinge blocks so as to be rotatable about an axis adjacent and parallel to the first edge, each end having stop means engagable with the hinge blocks at two angularly displaced locations so as to limit relative rotation between the link and the hinge block and thereby define a fully closed condition and a fully opened condition for the hinge block relative to the link; and gravity urged restraining means selectively operative during launch upon the stop means for ensuring sequential opening of the two hinge blocks.

2. A folding bridge as claimed in claim 1 wherein the end face of each hinge block is further provided with engagement means adjacent the second edge.

3. A folding bridge as claimed in claim 2 wherein the engagement means comprises mutually alignable holes in each hinge block through which a pin can be inserted.

4. A folding bridge as claimed in claim 1 wherein the gravity urged restraining means is comprised by the deadweight of the second bridge girder and controlled by the distribution thereof.

5. A folding bridge as claimed in claim 4 wherein the direction of engagement of the stop means defining the fully closed condition at the first end of the swinging link is arranged to provide that, when the second bridge girder is wholly dependent from the second end of the swinging link, a first locking moment is exerted at the stop means via the link by the said deadweight.

6. A folding bridge as claimed in claim 4 wherein the direction of engagement of the stop means defining the fully opened condition at the second end of the swinging link is arranged to provide that, when said condition is reached, the reactive force thereby engendered in the scissoring arm and linkage by consequent partial re-distribution of said deadweight, acts via the end-face of the second hinge block both to counter-act the first locking moment at the first hinge block and to apply a second locking moment at the said stop means of the second hinge block.

7. A folding bridge as claimed in claim 4 wherein the stop means at the first and the second end of the swinging link are symmetrically disposed, thereby permitting pivoting of either bridge girder.

* * * * *